United States Patent [19]

Diemer et al.

[11] 4,294,101

[45] Oct. 13, 1981

[54] METHOD OF MAKING SINGLE OR DOUBLE FLANGED TRACK TRACTOR ROLLER FOR OFF-HIGHWAY EQUIPMENT

[76] Inventors: Donald J. Diemer, 4355 Brendan La., North Olmsted, Ohio 44070; Ralph D. Delio, R.D. #1 Susan Trace, New Wilmington, Pa. 16142

[21] Appl. No.: 2,851

[22] Filed: Jan. 12, 1979

[51] Int. Cl.[3] ..... B21D 22/00; B21K 1/28

[52] U.S. Cl. ..... 72/356; 72/334; 72/358

[58] Field of Search ..... 72/356, 354, 359, 358, 72/360, 361, 420, 334

[56] References Cited

U.S. PATENT DOCUMENTS

| | | | |
|---|---|---|---|
| 585,821 | 7/1897 | Kent | 72/353 |
| 1,124,359 | 1/1915 | Taylor | 72/356 |
| 1,397,566 | 11/1921 | Walter | 72/353 |
| 2,105,289 | 1/1938 | Lobdell | 72/353 |
| 2,333,418 | 11/1943 | Fischer | 72/358 |
| 2,342,021 | 2/1944 | Swanson | 72/358 |
| 4,074,559 | 2/1978 | Beane | 72/354 |

*Primary Examiner*—Nicholas P. Godici
*Assistant Examiner*—Gene P. Crosby
*Attorney, Agent, or Firm*—Fay & Sharpe

[57] ABSTRACT

A method of forging track tractor rollers, which comprises busting of a billet to a preformed coned end and placing a split ring around the coned end of the busted and preformed billet, and inserting the same in a blocking die to form flanges by blocking against the split ring and removing the split ring and billet. When placed in a finishing die, the hollow of the roller is preformed by a displacement method which forces the metal into the flanges against the split ring.

29 Claims, 15 Drawing Figures

FIG. 10
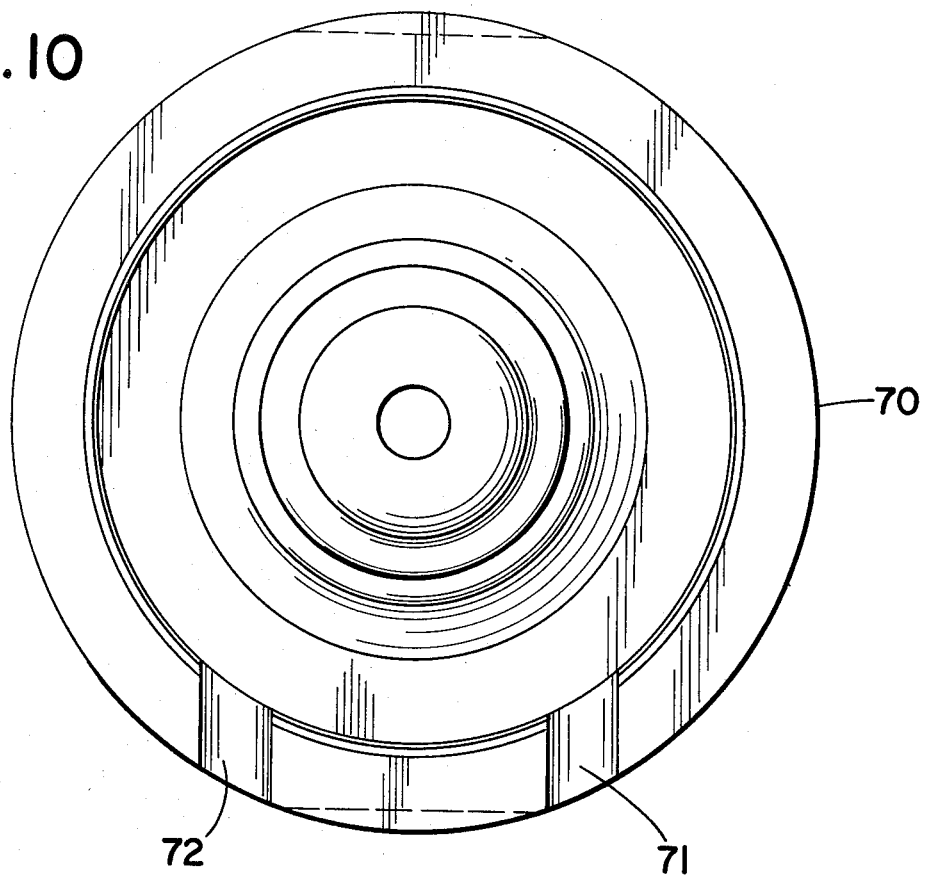
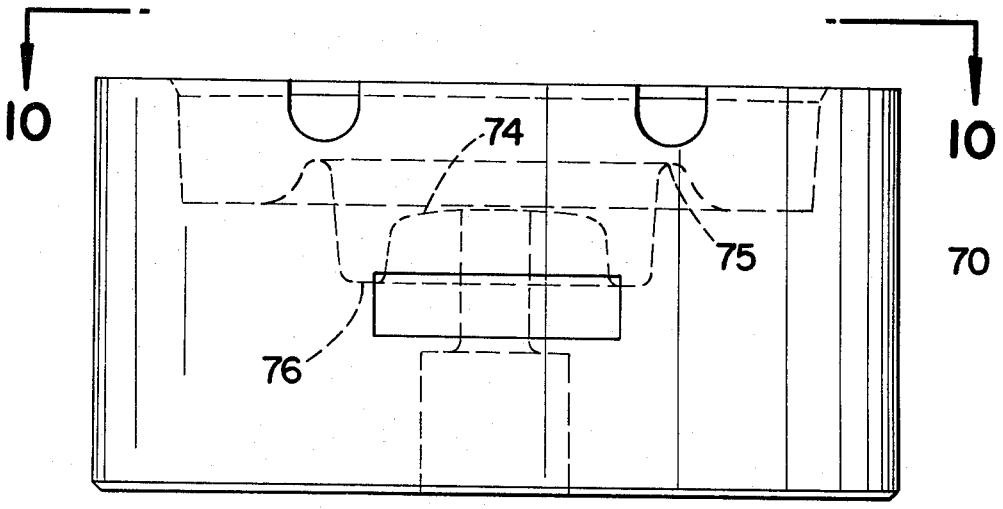
FIG. 11

FIG. 12
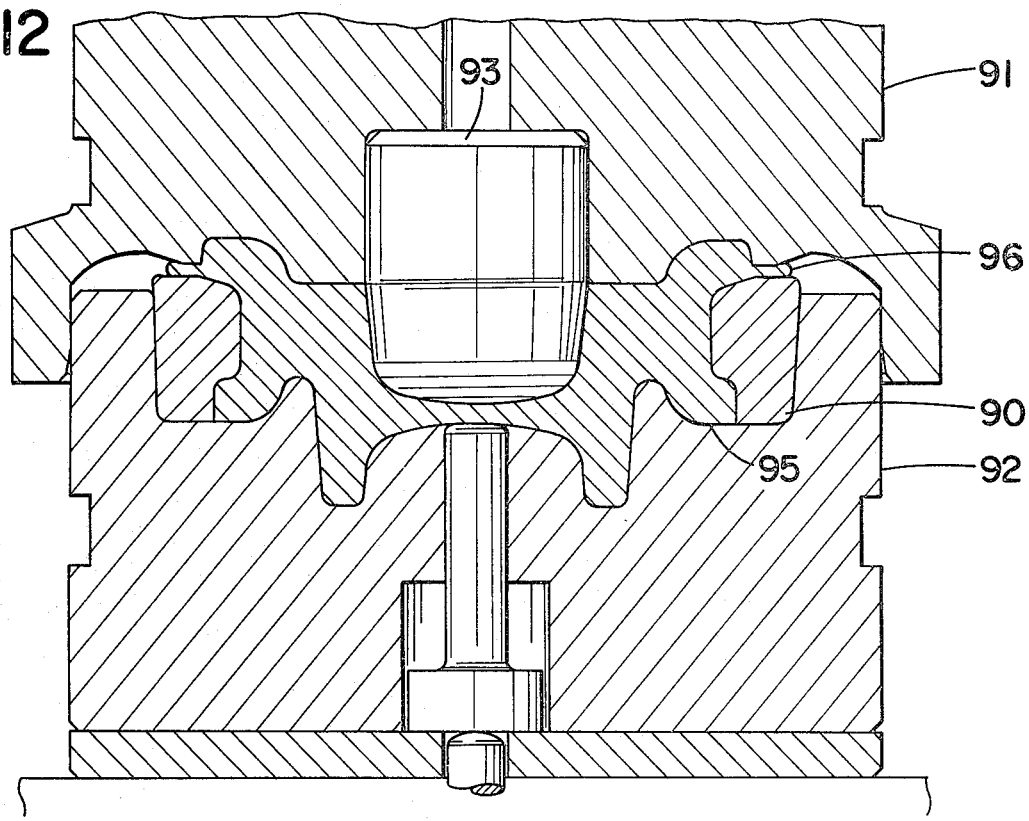
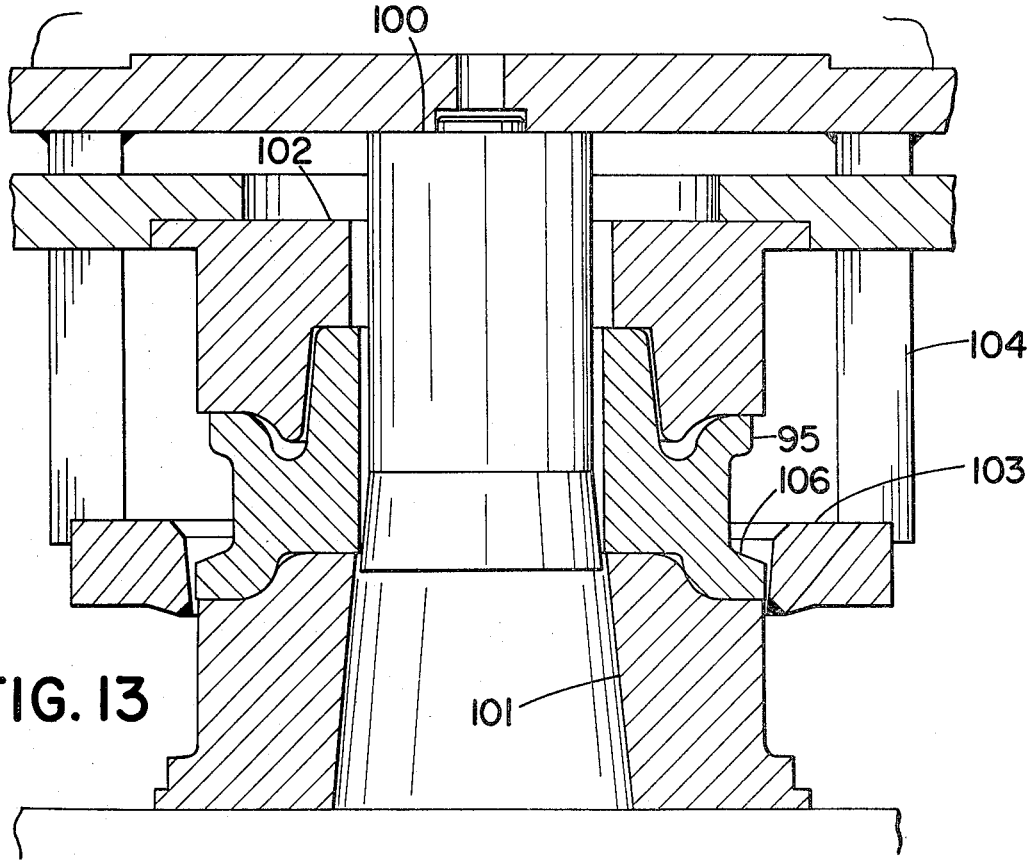
FIG. 13

METHOD OF MAKING SINGLE OR DOUBLE FLANGED TRACK TRACTOR ROLLER FOR OFF-HIGHWAY EQUIPMENT

BACKGROUND OF THE INVENTION

The current method of manufacturing single and double flanged track tractor rollers requires the welding together of two halves which are longitudinally split. Forgings are supplied in halves and the end of each half is machined to provide cavities for welding purposes. The halves are welded together to make one piece, then stress relieved at the welds and machine finished.

In connection with prior developments, forging of a double flanged roller is accomplished by busting and blocking in the conventional manner so that the larger flange is formed at the upper portion. The double flanged roller forging is then trimmed, pierced and moved to still another machine, known as a flanging press. The press includes two sliding side dies and a top die with a long protruding punch. The slide dies move horizontally to meet at the forging where the second flange is then formed. The top die moves in a vertical direction, with the long punch also moving vertically but through the top portion, after the sliding dies are positioned, and continuing down to form the second flange. Because of the nature of this type of operation, flashing of the second flange results in misalignment of the split sliding dies. Misalignment, of course, gives uneven surfaces between the two flanges. Flashing and uneven surfaces create problems in the machining operation and, thus, slower machine time.

The known track tractor rollers are made in halves, i.e. either the single flange or the double flange is of a different diameter than the first flange, but there are at least two half track tractor rollers which must be welded together to form a full track tractor roller. The present invention, however, makes either half rollers or full rollers with either single or double flanges.

The prior art developments are taught in such patents as the following: U.S. Pat. No. 585,821, H. P. Kent, July 6, 1897; U.S. Pat. No. 1,397,566, W. H. Walter, Nov. 22, 1921; U.S. Pat. No. 2,105,289, E. J. Lobdell, Jr., Jan. 11, 1938.

Kent U.S. Pat. No. 585,821 discloses a device for manufacturing a watch rim center wherein a split ring die F is positioned within a die block H to form a bead on the outer surface of the watch rim. The ring die F is employed in a similar manner as that discussed in the present invention, but the ring die in Kent does not include tongs nor would it be suitable for use in manufacturing a track tractor roller as described and claimed herein.

Walter. U.S. Pat. No. 1,397,566 teaches sliding dies 3, which are moved into position relative to wheel 13 to form spaced annular flanges 14 on the outer surface thereof. Walter does not disclose split rings being connected together by means of tongs.

Lobdell U.S. Pat. No. 2,105,289 teaches a press wherein a confining ring 15, having a plurality of elements, is connected together by hinges 27. The confining ring of Lobdell is positioned within a press. However, the confinging ring does not include tongs nor is it entirely positioned within the press.

SUMMARY OF THE INVENTION

In the method of the present invention, it is possible to make either one half of a track tractor roller or the full roller in a single forging operation in the manner hereinafter to be described. Forging is accomplished in a pierce by displacement method, which uses a technique employing split rings and tongs for fastening around a forging while in the blocking and finishing dies of the forging process.

Therefore, the present invention is directed to a method of forging single or double flanged track tractor rollers which are especially suited for off-highway equipment. The half or full track tractor roller may be produced by taking 4–5 inch, $\frac{1}{4}''$ round-cornered squares, initiating a busting operation to break off the scale on the heated metal and then forming a large flange. Split rings and tongs are then placed around the flange and onto the body of the forging. This forging and the split rings are inserted into a blocking die where a pierce by displacement technique is employed so that the metal is formed in the inside of the split rings for the flanges of the roller.

The handle for the split rings (a part of the tongs) projects through the pair of dies but doesn't touch. The forging and tongs are removed and placed into the finishing die to further complete the operation in a pierce by displacement forging for forming the half or full track tractor roller against the split rings. Then the forging and split rings are removed. When the split rings are removed from the forging, the forging is ready for the punching and trimming operation, being held in position between a nest and a stripper, so that a circular trim rings cuts the flange to its finished dimension and the punch makes the cavity in the track tractor roller. The forging is thus ready for its final machining operation.

The basic steps of the invention consist of taking a heated billet and busting it to knock off the scale, preforming the billet to a coned end around which a pair of split rings may be slipped on underneath the flange, together with a tong to handle the split rings. By insertion into a preforming die, the initial stages of a pierce by displacement techique is employed whereby the billet is formed against the internal flange and against the split rings to determine the outside contour for either the half or full track tractor roller.

The forging and the split rings are taken from the blocking die and placed into a finishing die so that the pierce by displacement techniques may be completed, and the metal in the forging is forced to conform with the split rings to form the outside contour of a track tractor roller. By this means a single flashing is produced which permits metal stress relief. The split rings and forging are then removed from the finishing die. The split rings are now off the die, and the forging is placed into a punch and is held in position by a stripper for the trimming operation. The outside trim ring cuts off the track tractor roller flange flashing, and the punch is directed down the center of the roller so that it punches through a cavity which has been formed by the pierce displacement blocking and finishing operation, and thus the cylindrical form of the track tractor roller is completed.

The invention then is directed to a new and improved forging technique which uses a pierce by displacement method so that a half or full track tractor roller may be formed in a forging press, the novel steps of which consist of containing the forge in a pair of split rings that are held together by means of tongs. A track tractor roller is formed in a vertical position, i.e. along the axis of the roller, and against the sides of the split rings to form circumferential flanges, and at the same time in several operations. A blocking and finishing operation forms a cavity in the roller, forcing the metal into the flanges so that the split rings and tongs may be removed from the forging, after which piercing and trimming take place.

Further, the invention provides for simplification of the track tractor roller forming steps. A single-double flanged roller and a double-double flanged roller may be produced in a single set of forging operations, eliminating the requirement of welding separate parts together.

The invention provides a new and improved technique for the manufacture of a half track tractor roller in a single forging step by the employment of split rings and tongs which form circumferential flanges while at the same time the pierce by displacement method forms a cavity within the roller.

One further embodiment of the invention is to produce a cluster gear blank and/or a bicycle hub in the manner used to produce the track tractor roller.

BRIEF DESCRIPTION OF THE DRAWINGS

FIG. 10 is a top view of the bottom finishing die, taken along the lines 10—10 of FIG. 11;

FIG. 11 is a side view of the bottom die, showing the openings for the tongs;

FIG. 12 is a cross-sectional view of the track tractor roller being formed, showing the top and bottom finishing dies, with the split rings in position;

FIG. 13 is a cross-sectional view of the punching and trimming operations of the roller, showing the split rings removed and the part inverted;

DESCRIPTION OF THE PREFERRED EMBODIMENTS

The method heretofore known of manufacturing single and double flanged track tractor rollers requires welding together of two halves which are longitudinally split. Forgings are supplied in halves, and the ends of each half are machined to provide cavities for welding, and then the two halves are welded together to make one. The piece is then stress relieved, welded and machine finished.

In the present invention, however, it is possible to produce single and double flanged rollers (normally two halves in one piece) by means of the use of split rings and pierce by displacement on a mechanical forging press. The size of such rollers vary from 20–140 pounds per half. In other words, the parts may be from 40–280 pounds and are made on a mechanical press having a capacity which ranges from 2,500 to 8,000–10,000 tons.

The invention takes into consideration the following processing steps:

1. Busting and Preforming

Figure 1:
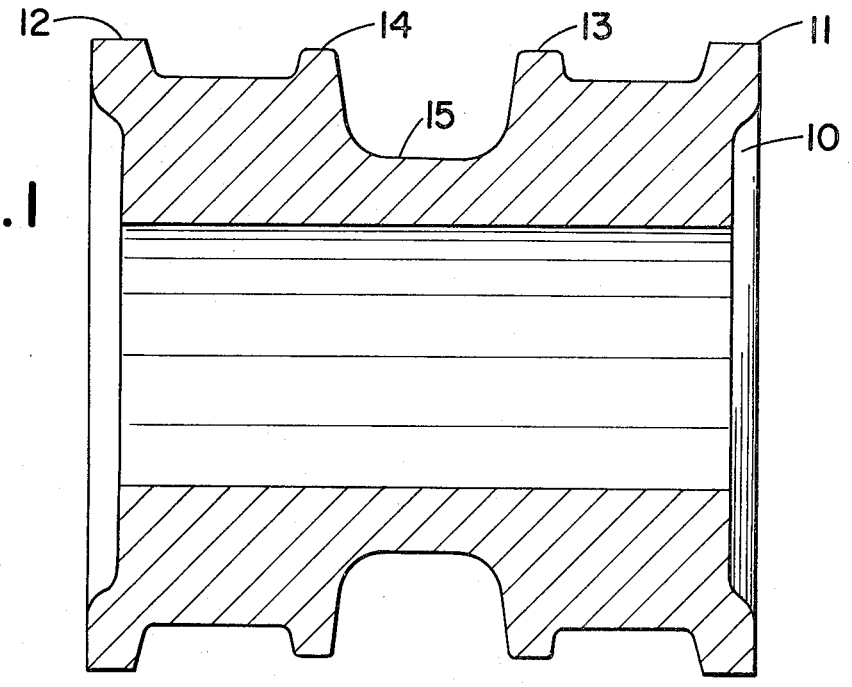
FIG. 1 is an axial cross section of the finished double flanged track tractor roller.
Figure 2:
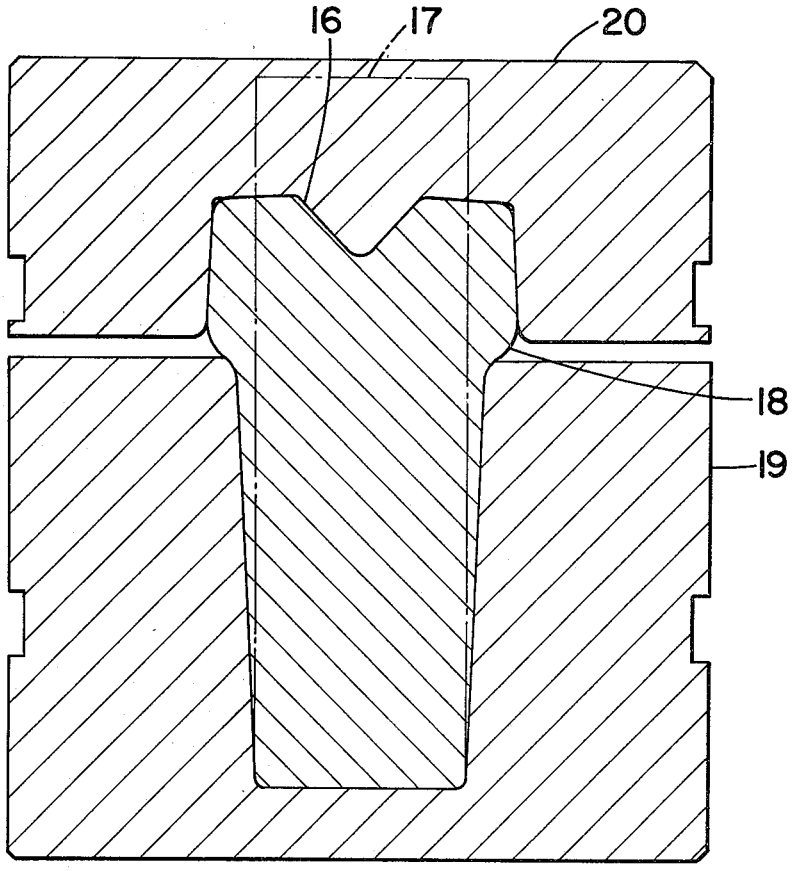
FIG. 2 is a cross section through the first operation of preforming the raw round material.

From a round or round-cornered square billet of a size 4–5¾ inches, raw hot material is squeezed between open dies to break off scale and is then formed with a coned end and an enlarged head, which may be seen in connection with FIG. 2 of the drawings. FIG. 1 generally shows a double flanged track tractor roller at 10 with an outside flange on one side at 11 and on the other side at 12. Inside flanges are noted at 13 and 14. Prior to the present invention, rollers were typically made in two pieces, such as shown generally at 15. In FIG. 2, which is actually the busting operation, a round billet 17 is busted, i.e. the scale is broken off the billet, and it is formed with a head or large section which is shown generally at 18 and then formed in the cavity of the bottom die 19. The upper die is noted at 20. The head section or flange 18 permits enclosing of the billet with a split ring. A locator 16 is formed in the billet.

2. Blocking

Figure 3:
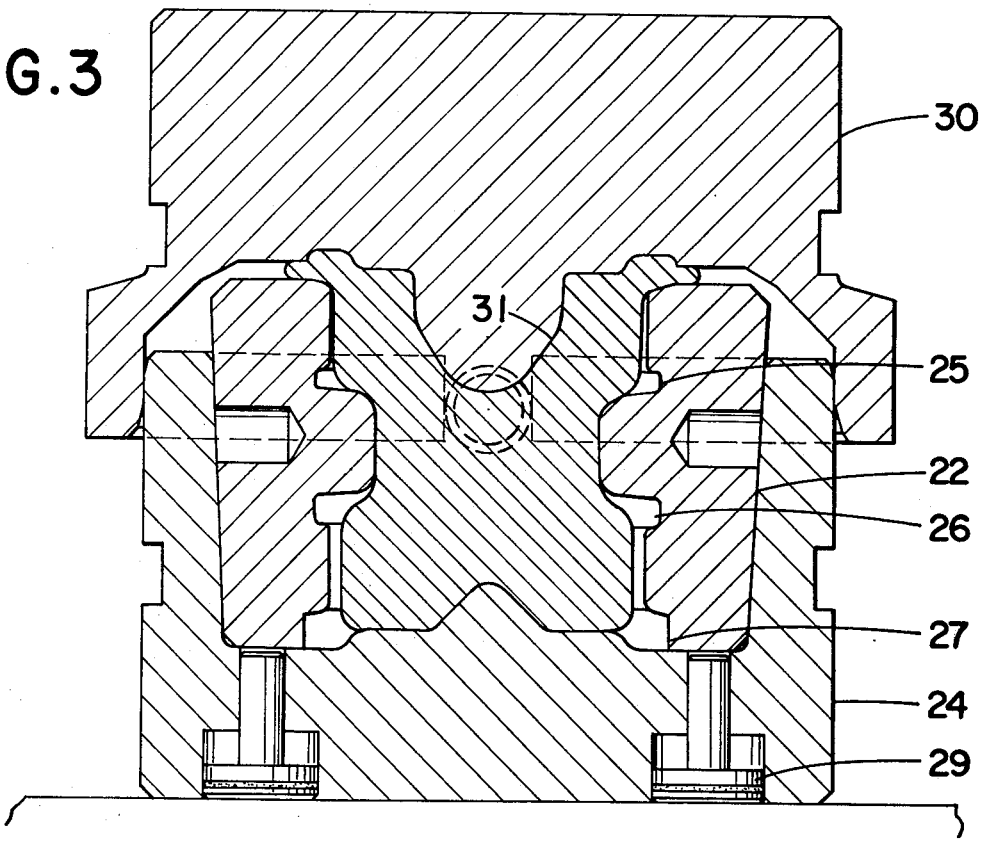
FIG. 3 is a cross section of the second operation, the blocking operation, in which the split rings are used to hold the forging.

The second operation or blocking operation is shown in connection with FIG. 3. The part is shown formed, from the position noted in FIG. 2, and inverted. It has first been clamped between split ring 22 in the bottom blocking die 24. The interior conformation of the split ring is formed to comply with the conformation of the exterior surface of the double flanged full track tractor roller. The grooves for the roller flanges are shown at 25, 26 and 27.

In this blocking operation, hot metal is placed in the bottom blocking die 24, and the rings are inserted. The metal is thus forged with the top die 30 and its center displacement member 31 closing on the bottom die. The forging and the split rings are then removed, aided by means of air injectors 29, with the rings and tongs in place and placed in position for the next operation (see FIG. 4), i.e. the finishing die.

It will be understood, of course, that as to the manner of inserting the split rings and tongs into the finishing die that a simple pin 38 is attached to the split rings in the bottom die for insertion by other means not shown herein. It allows the plunger of the top die to be pulled from the forging without pulling out the forging and the split rings.

3. Finishing and Piercing Holes by Displacement

Figure 4:
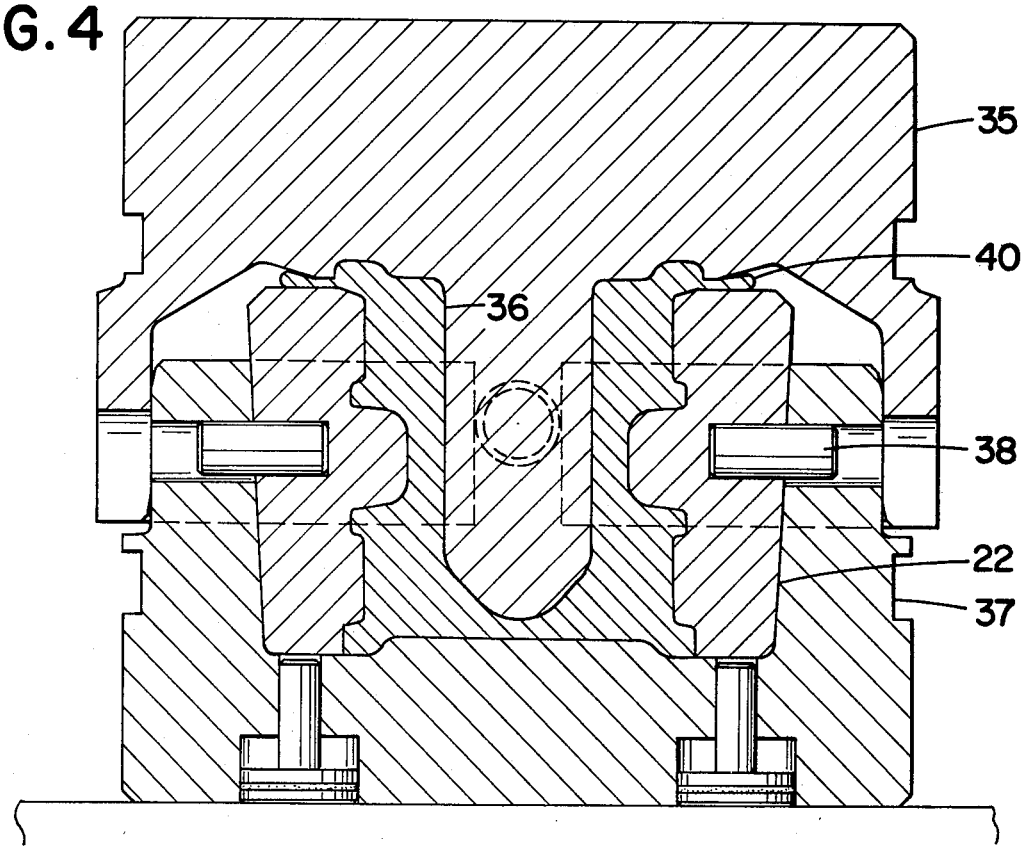
FIG. 4 is a cross section of the third operation, the finishing and pierce by displacement operation, which illustrates the formation of the central cavity.

In connection with FIG. 4 there is a top finishing die which incorporates a large displacement member or die plug 36 and projects deeply into the forging. The bottom finishing die 37 and the split rings are shown in this figure at 22, while at 38 are noted the locking pins. The forging in this case is pushed from the cavity in the center to the rims in the same volume as left unfilled from the blocking die. The openings should be noted which occurred in FIG. 3 around the grooves or flanges 25, 26 and 27, which permit the top finishing die plug 36 to displace material to fill up the rings with very little pressure applied. The metal which is left in the center from the blocker is displaced forward and also sidewise into the ring cavity. A small rib is left where the rings join together which is then cold trimmed in a subsequent operation. There is, of course, a flashing at 40 which is formed in this particular operation.

4. Trimming and Punching Holes

The part indicated at 41 is the full track tractor roller, and it is placed into a trim and punch set of dies. The nest into which the lower flange is positioned is shown at 42; the stripper is shown at 43; the trim ring 44 is mounted on a drum as at 45, and it operates in conjunction with the punch 46. Thus, as the trim and punch die comes down, the center cavity is punched out. The portion of metal clearly seen in connection with FIG. 4 was not punched through. The punch 46 will punch out this cavity and also trim off the flashing indicated at 40 in FIG. 4, by means of a scalpel trimmer 44 having a cutting notch 47, at 180° apart, so as to split the flashing and permit easy separation.

Generally the forging in the split rings and tongs are handled by a conveyor system or monorail system from the forging press to the trimming press. Numerous sets of rings and tongs are provided on the rail system, and the operators take the parts from the forging press to the trimming press.

Figure 6:
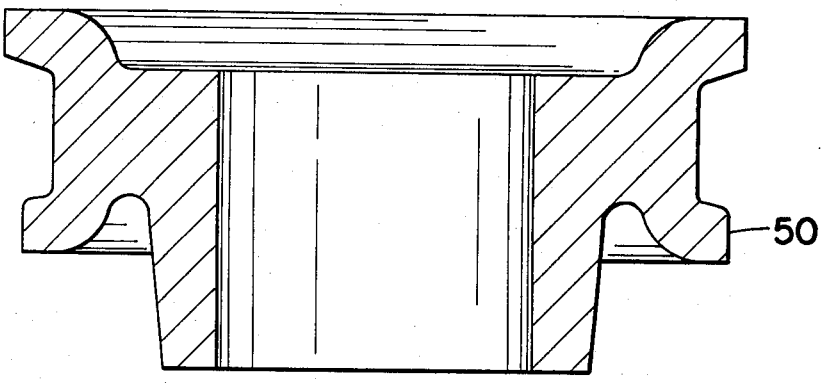
FIG. 6 is an axial cross section of the half track tractor roller, showing the double flanged roller, which would be welded together circumferentially.
Figure 7:
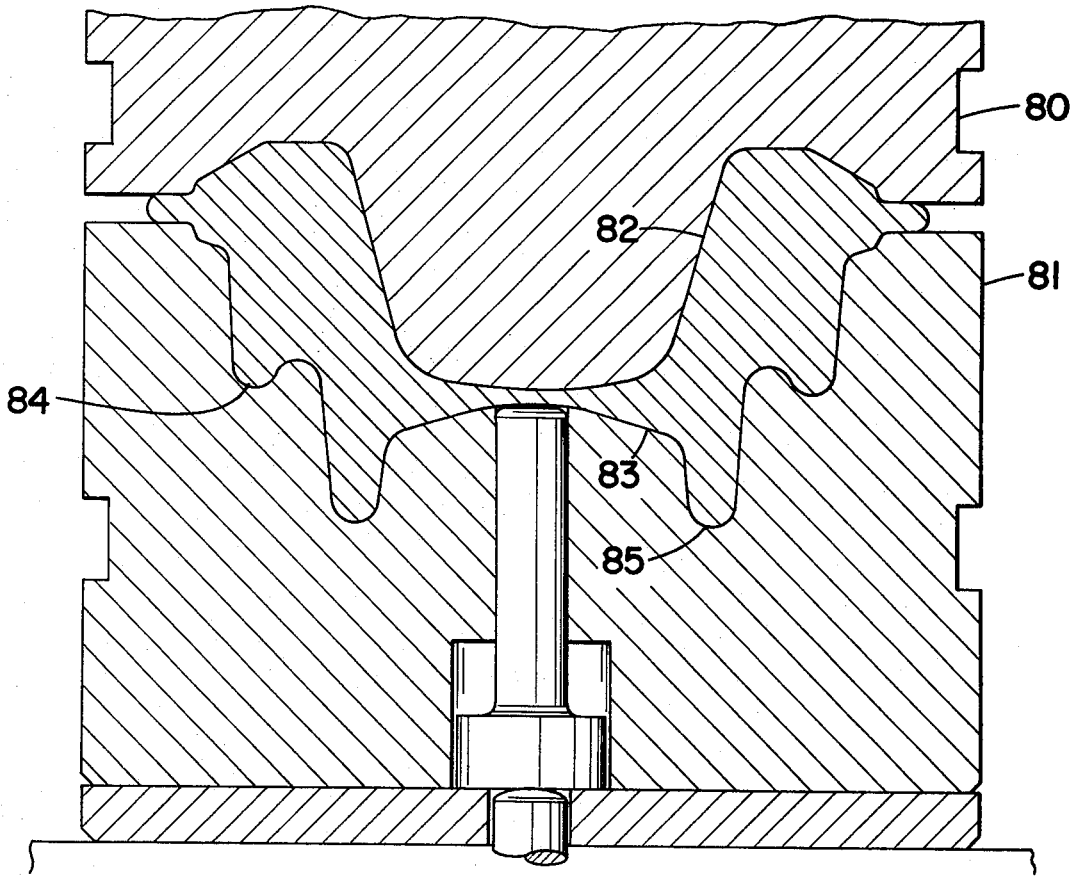
FIG. 7 is a cross section of the first forming operation, after busting, to illustrate the rough outline of the track tractor roller.

A further example of a track tractor roller is shown in connection with FIG. 6. One half is noted at 50, while the other half (not shown) is welded to it after the machining operation. Manufacutre is accomplished in the following manner:

First, the busting and preforming operation is performed, in the manner shown in connection with FIG. 2, wherein a head or flange member is formed after it is descaled. The forging blank is then placed in the blocking die as shown in connection with FIG. 7, where a top blocking die is noted at 80, with a bottom blocking die at 81. The top die includes a deep projection 82 which aids in forming the cavity, and the bottom die includes a similar projection 83 and forms the remaining half of the cavity. There are two cylindrical recesses in the bottom die, 84 and 85, which form the portions of the track tractor roller that fit into the finishing die.

Figure 8:
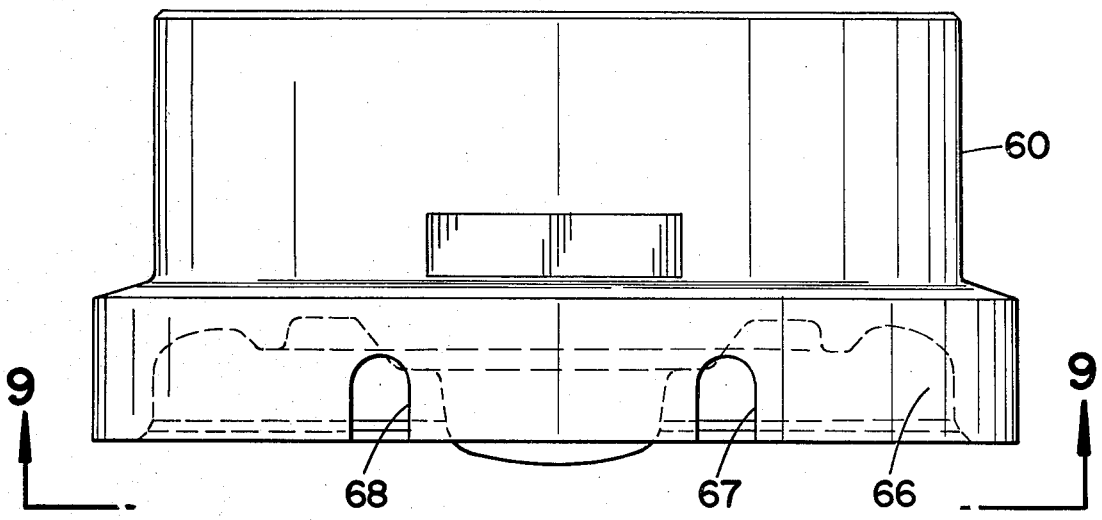
FIG. 8 is a side view of the top finishing die.

Specific parts of the finishing die are more clearly illustrated in connection with FIG. 8, where there is a top finishing die 60, and the interior conformation of the die is generally shown in dotted lines at 66, and the apertures or openings for the tongs are shown at 67 and 68.

Figure 9:
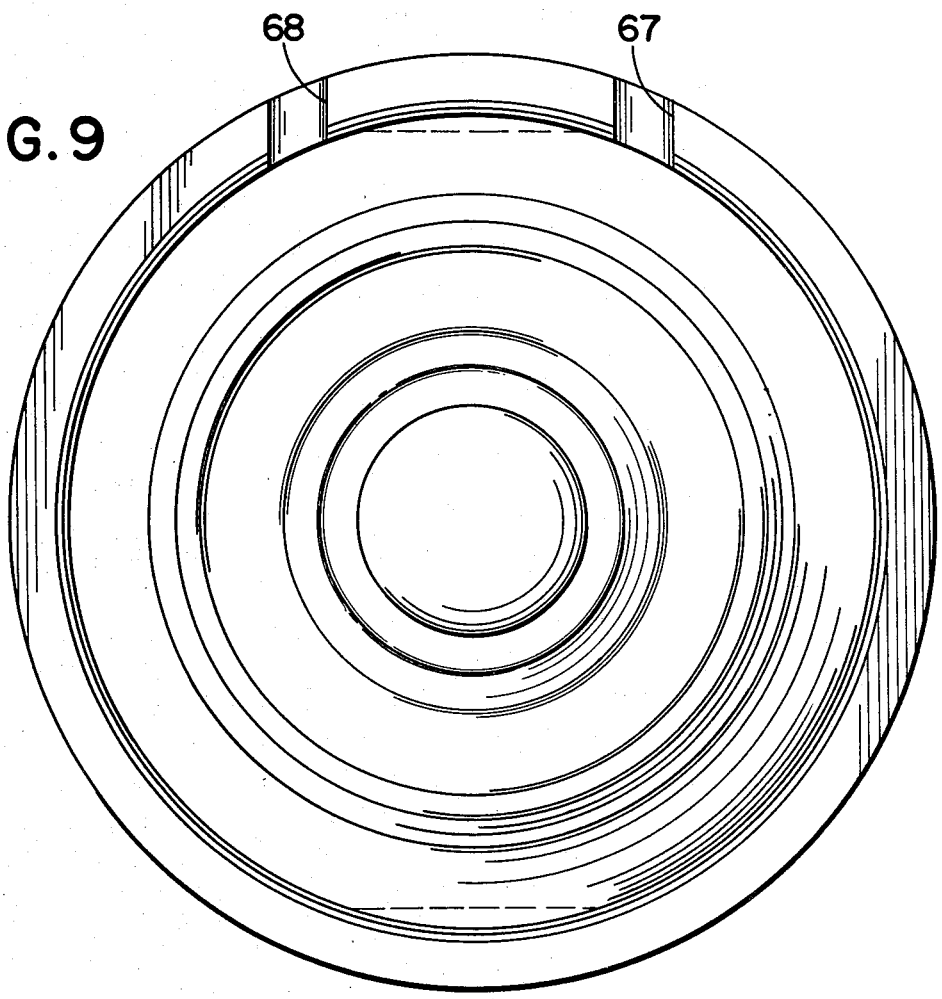
FIG. 9 is an underside view of the die of FIG. 8, taken along the lines 9—9, showing the openings for the tongs attached to the split rings.

FIG. 9 illustrates the underside view of the top finishing die, and FIG. 10 shows the bottom finishing die with the top facing up, as at 70. Apertures for the tongs are noted at 71 and 72, and the various conformations for forming the bottom finishing die may be seen in dotted lines as at 73. In general operation, there is a center punch section which begins to punch out the cavity as at 74. An upstanding rib 75 and depression 76 form the cylindrical portion of the roller in relation to the cavity.

Figure 5:
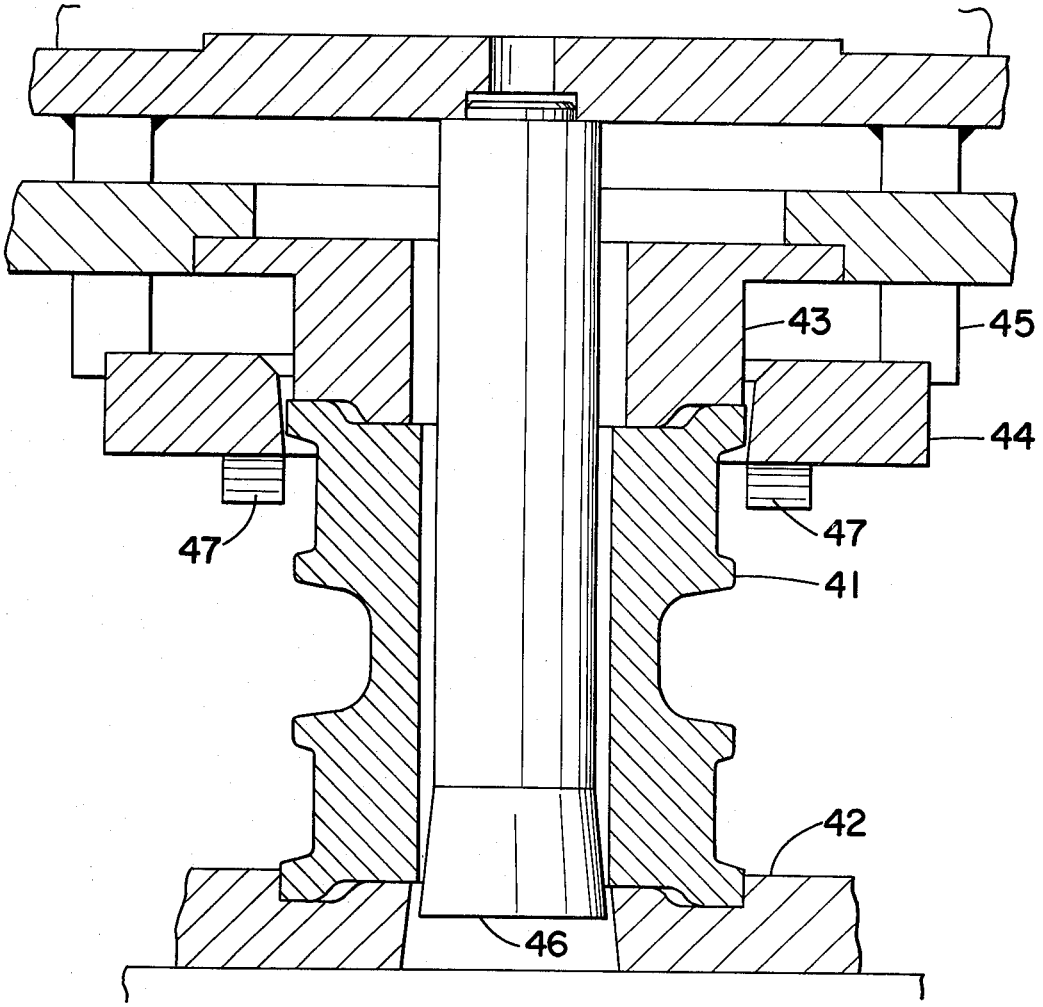
FIG. 5 is a cross section of the punching and trimming operation, after the part has been removed from the split rings, illustrating the punching operation through the central cavity and trimming of the roller flange.

In connection with FIG. 12, after the roller has been formed, a pair of split rings 90 are mounted around the forging and placed into a bottom finishing die, indicated at 92. In this particular instance, metal is forced from the cavity by means of a large center plunger member 93, and the metal is thus forced into the inner flange 95 whereby a flashing is formed between the top die 91 and the bottom die 92, indicated at 96. The forging is ejected from the bottom die, the split rings and tongs are opened, and the forging is placed into a trim and punch die, comparable to the FIG. 5 operation.

FIG. 13 includes a nest 101 and a stripper 102 as well as a trim ring 103, which is held in position by posts attached to punch 100. The punch and trim ring are forced through the cavity formed by the pierce by displacement method (see FIGS. 7 and 12), so that a completed half track tractor is formed, having a trimmed outside flange 106 and an inner flange of slightly lesser diameter 95, so that the trim ring may pass by flange 95 in rimming flange 106.

With respect to the way in which the split ring flashing is removed and trimmed from the die, the standard method in the industry is employed. The forging is inserted into a trimming die having a trimming blade therein, and a punch forces the work piece and also cuts off the flashing in a simple operation. No disclosure is intended for the purposes of this invention since the operation is well known in the industry.

The pair of tongs noted in the forging steps and shown in both FIGS. 3, 4 and 8–12 is particularly illustrated in connection with FIG. 14. The handles for the tongs are at 110 and 111, pivoted as at 112, and welded as at 113 to the rings 114 on the right and 115 on the left, as noted in dotted lines, and as shown in the position of the two split rings as they are opened.

Figure 14:
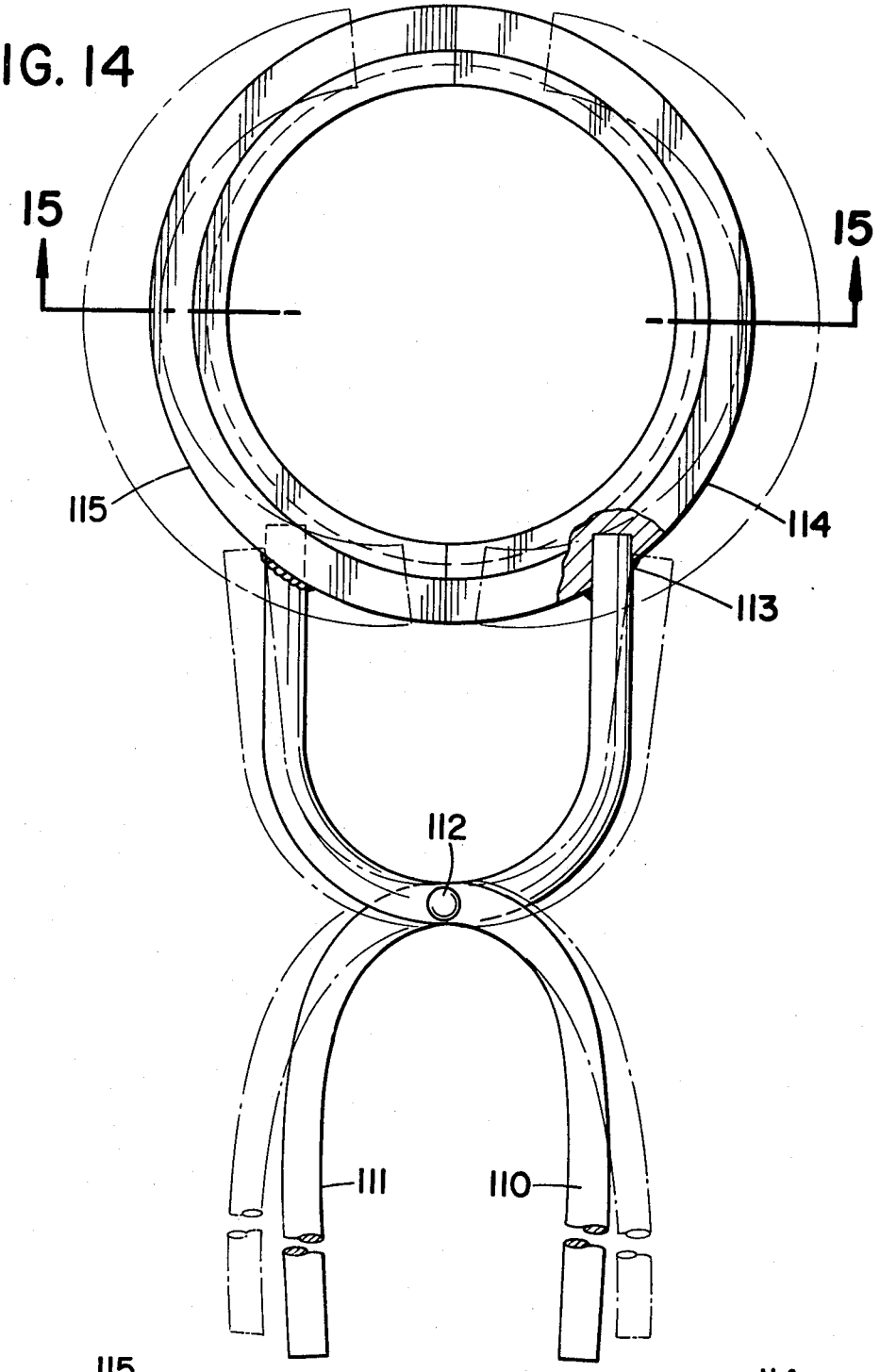
FIG. 14 is a plan view of the split rings with tongs attached.
Figure 15:
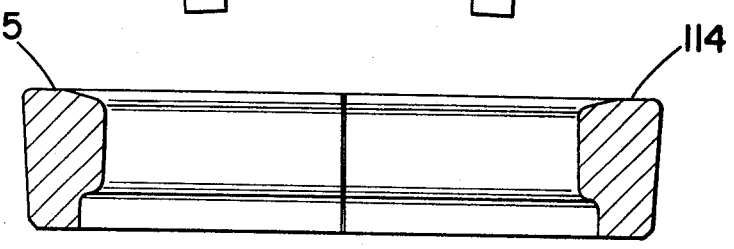
FIG. 15 is a cross-sectional view, taken along the lines 15—15 of FIG. 14.

FIG. 15 is a cross section along the lines 15—15 of FIG. 14, where the grooves shown form the inner flange of the track tractor roller, which is of lesser diameter than the outer flange.

The technique of this invention results in a higher quality product particularly in terms of the one-piece version since the separate halves need not be welded together. Additionally, since the forging is much cheaper to produce, there are great savings involved by the means in use in this invention. The greatest advantage over the prior art developments is the fact that handling steps are reduced and the invention takes into consideration the forging of a single track tractor roller, which up to this time has not been possible to accomplish.

The invention furthermore takes into account the forging of other items that require a central cavity and an exterior conformation, such as cluster gears and cam flanges, as examples, as well as possibly bicycle hubs, all of which might be processed in the manner of a track tractor roller.

Although the invention has been shown and described with respect to preferred and alternative embodiments, modifications and alterations will occur to others upon a reading and understanding of this specification. The present invention includes all such modifications and alterations insofar as they come within the scope of the appended claims or the equivalents thereof.

What is claimed is:

1. A method of closed die forging to form a flanged cylindrical metal part having at least two exterior cylindrical flanges and a cylindrical cavity, which comprises the steps of:

A. busting and preforming a heated billet to a cylindrical shape having one end and an axially opposite other end;

B. thereafter inserting the billet and a split ring outwardly thereof into a set of dies, said ring having an interior conformation with at least one interior cylindrical groove to form a first flange;

C. mating and supporting said ring within a first one of said dies to effectively close one end of said ring;

D. closing the other end of said ring with the other die to forge said billet; and E. thereafter removing the split ring and billet together from said first-mentioned dies and placing the split ring and billet into a set of finishing dies, which finish forms the flanges and the cylindrical cavity, thereby displacing metal from the center of the billet into the flanges while forming the cylindrical cavity.

2. The method of claim 1 in which the cylindrical metal part is a tractor track roller.

3. The method of claim 1 in which the cylindrical metal part is a cluster gear blank.

4. The method of claim 1 in which the cylindrical metal part is a bicycle hub.

5. The method of claim 1 in which the part is trimmed to remove flashing around one of the flanges and punched axially all in a single operation to form the cavity into a cylindrical thru hole.

6. The method of claim 1 in which tongs are fixed to the split ring and carry the split ring and billet from the first mentioned set of dies to the finishing dies.

7. The method of claim 1 in which the split ring has a radial aperture outwardly into the bottom finishing die adapted for a locking pin to prevent uplift of the ring in finish forging.

8. The method of claim 1, wherein said step of closing to forge the billet pierces the billet at said one end to form a piercing end cavity that partially forms the cylindrical cavity and thereby displaces metal radially outward of the piercing end cavity toward said one groove to partially form said first flange.

9. The method of claim 1, wherein said step of busting and preforming forges the billet by piercing along the axis of its cylindrical shape through said other end to displace metal radially outward to produce an enlarged head at said other end; and said step of closing to forge further pierces said other end of said billet along said axis to displace metal radially outward toward a second groove of said ring to partially form a second flange.

10. The method of claim 9, wherein said step of placing, which finish forms, further pierces said billet from a first of said ends to within at least close proximity of the second of said ends along said axis and radially displaces metal thereby into said one groove to finish form said first flange adjacent said one end and into said second groove in said split ring adjacent said other end of said billet as an outward continuation of said head to finish form said second flange.

11. The method of claim 10, wherein said step of closing to forge displaces metal radially outward at said other end of said ring to form a third flange at said other end between said other die and said split ring, and at least one of said steps of closing to forge and placing to finish form displaces metal, radially outward of said third flange and said other of said ring to form an annular flashing around said third flange; and further including the step of simultaneously trimming to remove said flashing from said third flange and axially punch through said cavity to form a thru cylindrical hole.

12. The method of claim 11, wherein said step of placing to finish form radially displaces metal outwardly at said one end of said ring to form a fourth flange at said one end between said split ring and one of said finishing dies.

13. The method of claim 1, wherein said step of closing to forge displaces metal radially outwardly at said other end of said ring to form another flange at said other end between said other die and said split ring, and at least one of said steps of closing to forge and placing to finish form displaces metal radially outward of said another flange and said other end of said ring to form an annular flashing around said another flange; and further including the step of simultaneously trimming to remove said flashing from said another flange and axially punch through said cavity to form a thru cylindrical hole.

14. The method of claim 13, wherein said step of placing to finish form radially displaces metal outwardly at said one end of said ring to form still another flange at said one end between said split ring and one of said finishing dies.

15. A method of closed die forging to form a tractor track roller having a cylindrical cavity and at least two flanges by using a split ring and a pierce by displacement forging method, which comprises the steps of:

A. busting and preforming a heated billet to a cylindrical shape having one end and an axially opposite other end;

B. thereafter forging the billet in steps which follow to form a roller that has substantial metal in at least two flanges and a cavity for the roller;

C. inserting the billet and a split ring outwardly thereof into one of a first set of dies, said ring having an interior conformation with at least one interior cylindrical groove to form a first flange;

D. mating and supporting said ring with one of said dies to effectively close one end of said ring;

E. closing the other end of said ring with the other die to forge said billet; and F. thereafter removing the split ring and forged billet together from said first mentioned dies and placing the split ring and billet into a set of finishing dies, which finish forms the flanges and completes the forging of the cylindrical cavity by pierce by displacement that displaces metal from the center of the billet into the flanges while forming the cylindrical cavity.

16. The method of claim 15, wherein said step of closing to forge the billet pierces the billet at said one end to form a piercing end cavity that partially forms the cylindrical cavity and thereby displaces metal radially outward of the piercing end cavity toward said one groove to partially form said first flange.

17. The method of claim 16, wherein said step of busting and preforming forges the billet by piercing along the axis of its cylindrical shape through said other end to displace metal radially outward to produce an enlarged head at said other end; and said step of closing to forge further pierces said other end of said billet along said axis to displace metal radially outward toward a second groove of said ring to partially form a second flange.

18. The method of claim 17, wherein said step of placing, which finish forms, further pierces said billet from a first of said ends to within at least close proximity of the second of said ends along said axis and radially displaces metal thereby into said one groove to finish form said first flange adjacent said one end and into said second groove in said split ring adjacent said other end of said billet as an outward continuation of said head to finish form said second flange.

19. The method of claim 18, wherein said step of closing to forge displaces metal radially outward at said other end of said ring to form a third flange at said other end between said other die and said split ring, and at least one of said steps of closing to forge and placing to finish form displaces metal radially outward of said third flange and said other end of said ring to form an annular flashing around said third flange; and further including the step of simultaneously trimming to remove said flashing from said third flange and axially punch through said cavity to form a thru cylindrical hole.

20. The method of claim 19, wherein said step of placing to finish form radially displaces metal outwardly at said one end of said ring to form a fourth flange at said one end between said split ring and one of said finishing dies.

21. The method of claim 15, wherein said step of closing to forge displaces metal radially outward at said other end of said ring to form another flange at said other end between said other die and said split ring, and at least one of said steps of closing to forge and placing to finish form displaces metal radially outward of said another flange and said other end of said ring to form an annular flashing around said another flange; and further including the step of simultaneously trimming to remove said flashing from said another flange and axially punch through said cavity to form a thru cylindrical hole.

22. The method of claim 21, wherein said step of placing to finish form radially displaces metal outwardly at said one end of said ring to form still another flange at said one end between said split ring and one of said finishing dies.

23. The method of claim 15 in which the roller is trimmed to remove flashing and is punched axially all in a single operation to form the cavity into a cylindrical thru hole.

24. The method of claim 23 in which the roller is trimmed with a scalpel trimmer to part the flashing.

25. The method of claim 15 in which tongs are fixed to the split ring and carry the split ring and billet into and out of the dies.

26. The method of claim 15 in which the split ring has a radial operative opening outwardly into the bottom finishing die adapted for locking pins to prevent uplift of the ring in finish forging.

27. The method of claim 8 in which a full tractor roller is forged.

28. A method of closed die forging to form a flanged cylindrical metal part having at least two exterior cylindrical flanges and a cylindrical cavity, which comprises the steps of:

busting and preforming a heated billet to a cylindrical shape having one end and an axially opposite other end, including partially piercing the billet along the axis of its cylindrical shape to form a cavity and displace metal radially outward to form a first enlarged head at said other end;

thereafter inserting the billet into a set of dies and forging the billet to pierce said one end of the billet along said axis and form a cavity to thereby displace metal radially outward at said one end to form a second enlarged head at said one end spaced from said first enlarged head with an annular recessed portion therebetween;

thereafter separately forging said billet by further piercing said billet along said axis from a first of said ends to substantially the second of said ends to displace metal radially outward at both of said heads into first and second grooves formed in a split ring to produce respective first and second flanges adjacent said ends; and thereafter punching through one of the cavities formed by said piercing to produce a cylindrical thru hole along said axis.

29. The method of claim 28, wherein said first step of forging displaces metal radially outward to form a third flange between a die and said split ring, and said second step of forging displaces metal radially outward to form a fourth flange between a die and said one end of said split ring opposite from said third flange.

* * * * *